US005813459A

United States Patent [19]

Carisella

[11] Patent Number: 5,813,459

[45] Date of Patent: Sep. 29, 1998

[54] PROGRAMMED SHAPE INFLATABLE PACKER DEVICE

[76] Inventor: James V. Carisella, P.O. Box 10498, New Orleans, La. 70181

[21] Appl. No.: 712,647

[22] Filed: Sep. 11, 1996

Related U.S. Application Data

[63] Continuation of Ser. No. 502,970, Jul. 17, 1995, Pat. No. 5,564,504, which is a continuation of Ser. No. 175,974, Dec. 30, 1993, Pat. No. 5,469,919.

[51] Int. Cl.[6] ..... E21B 33/127

[52] U.S. Cl. ..... 166/187; 277/334

[58] Field of Search ..... 166/187, 387; 277/34, 34.6; 138/93

[56] References Cited

U.S. PATENT DOCUMENTS

| | | | |
|---|---|---|---|
| 3,160,211 | 12/1964 | Malone | 166/187 |
| 3,289,761 | 12/1966 | Smith et al. | 166/187 X |
| 3,527,296 | 9/1970 | Malone | 166/122 |
| 3,529,665 | 9/1970 | Malone | 166/264 |
| 3,529,667 | 9/1970 | Malone | 166/315 |
| 3,542,127 | 11/1970 | Malone | 166/122 |
| 3,575,237 | 4/1971 | Malone | 166/152 |
| 3,581,816 | 6/1971 | Malone | 166/187 |
| 3,604,732 | 9/1971 | Malone | 285/106 |
| 3,606,924 | 9/1971 | Malone | 166/187 |
| 3,776,308 | 12/1973 | Malone | 166/187 |
| 3,837,947 | 9/1974 | Malone | 159/69 |
| 3,899,631 | 8/1975 | Clark | 174/47 |
| 3,912,014 | 10/1975 | Wetzel | 166/78 X |
| 3,941,190 | 3/1976 | Conover | 166/187 |
| 4,316,504 | 2/1982 | Baker et al. | 166/53 |
| 4,320,803 | 3/1982 | Manderscheid | 166/334 |
| 4,349,204 | 9/1982 | Malone | 277/34 |
| 4,352,394 | 10/1982 | Zehren | 166/106 |
| 4,413,653 | 11/1983 | Carter, Jr. | 277/34 X |
| 4,429,720 | 2/1984 | Beck et al. | 138/97 |
| 4,485,876 | 12/1984 | Speller | 166/373 |
| 4,535,843 | 8/1985 | Jageler | 166/250 |
| 4,614,346 | 9/1986 | Ito | 277/34 |
| 4,655,292 | 4/1987 | Halbardier | 166/387 |
| 4,708,208 | 11/1987 | Halbardier | 166/387 |
| 4,781,249 | 11/1988 | Wood | 166/187 |

(List continued on next page.)

FOREIGN PATENT DOCUMENTS

| | | |
|---|---|---|
| 1014065 | 7/1977 | Canada . |
| 1221027 | 4/1987 | Canada . |
| 1257197 | 7/1989 | Canada . |
| 1274721 | 10/1990 | Canada . |
| 2008152 | 10/1990 | Canada . |
| 2230800 | 10/1990 | United Kingdom . |
| 2230805 | 10/1990 | United Kingdom . |
| 2236779 | 4/1991 | United Kingdom . |

OTHER PUBLICATIONS

"New Inflation Testing Packer Improves Testing Capabilities"; Petroleum Society of CIM; Paper No. 79–30–08; pp. 1–8; Brandell et al.

"Pack/Perf Could Resolve Problem Completions" by J. P. Pitts; Drill Bit; pp. 84–85, Apr. 1980.

"Cement–Inflated Packer To Make North Sea Debut"; Offshore Drilling Technology; pp. 31, 33, Mar. 1986.

"Advancements in Drill Stem Testing Through The Use of Annular Pressusre Response Equipment and Improvements In Open Hole Testing Through Inflatable Packer Systems"; Hortman et al; SPE; pp. 729–735.

"New Completion System Eliminates Remedial Squeeze Cementing For Zone Isolation"; James E. Oliver; SPE of AIME; pp. 101–105.

*Primary Examiner*—Hoang C. Dang

*Attorney, Agent, or Firm*—Beirne Maynard & Parsons, L.L.P.

[57] ABSTRACT

An inflatable packer is provided for introduction into a subterranean well bore on a conduit. A pinch can form in the inflatable elastomeric bladder of the packer during inflation or deflation, forming a seal which obstructs the effective passage of pressured fluid, thereby obstructing inflation and deflation of the bladder. Additionally, ribs on the exterior of the bladder can cut into the bladder during nonuniform inflation or deflation of the bladder. The packer provides a series of shape-controllers to cause uniform inflation along the length of the bladder to eliminate these problems.

2 Claims, 2 Drawing Sheets

U.S. PATENT DOCUMENTS

| | | | |
|---|---|---|---|
| 4,805,699 | 2/1989 | Halbardier | 166/387 |
| 4,832,120 | 5/1989 | Coronado | 166/187 |
| 4,838,349 | 6/1989 | Berzin | 166/187 |
| 4,840,231 | 6/1989 | Berzin et al. | 166/387 |
| 4,897,139 | 1/1990 | Wood | 156/188 |
| 4,928,759 | 5/1990 | Siegfried, II et al. | 166/65.1 |
| 4,934,460 | 6/1990 | Coronado | 166/386 |
| 4,936,387 | 6/1990 | Rubbo | 166/387 |
| 4,941,534 | 7/1990 | Berzin | 166/285 |
| 4,951,747 | 8/1990 | Coronado | 166/187 |
| 4,962,812 | 10/1990 | Berzin | 166/187 |
| 4,962,815 | 10/1990 | Schultz et al. | 166/387 |
| 4,979,570 | 12/1990 | Mody | 166/387 |
| 5,020,600 | 6/1991 | Coronado | 166/387 |
| 5,044,444 | 9/1991 | Coronado | 166/387 |
| 5,101,908 | 4/1992 | Mody | 166/387 |
| 5,109,926 | 5/1992 | Mody et al. | 166/187 |
| 5,133,412 | 7/1992 | Coronado | 188/381 |
| 5,143,154 | 9/1992 | Mody et al. | 166/187 |
| 5,197,542 | 3/1993 | Coone | 166/187 |
| 5,242,019 | 9/1993 | Benker | 166/187 |
| 5,265,679 | 11/1993 | Coronado et al. | 166/324 |
| 5,280,824 | 1/1994 | Eslinger et al. | 166/187 |

FIG. 1
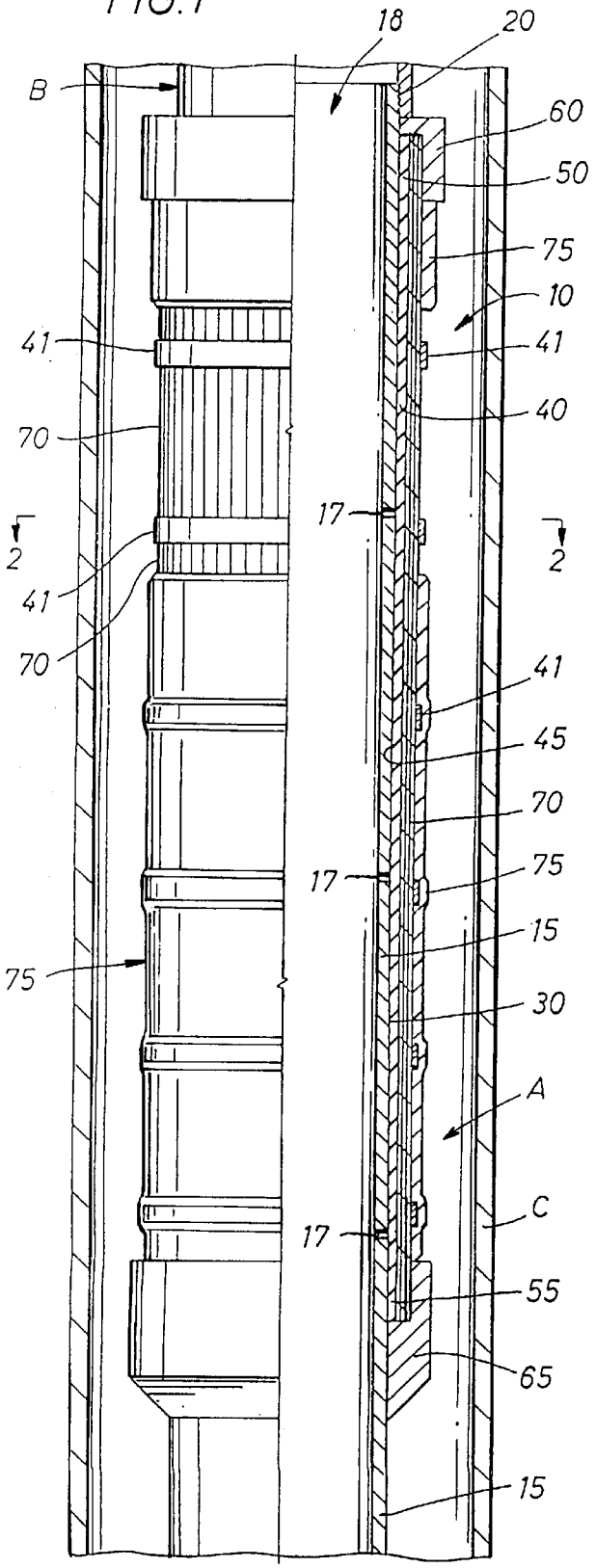
FIG. 2
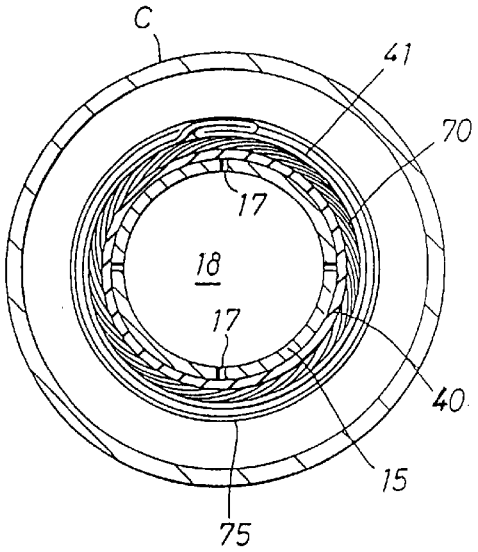
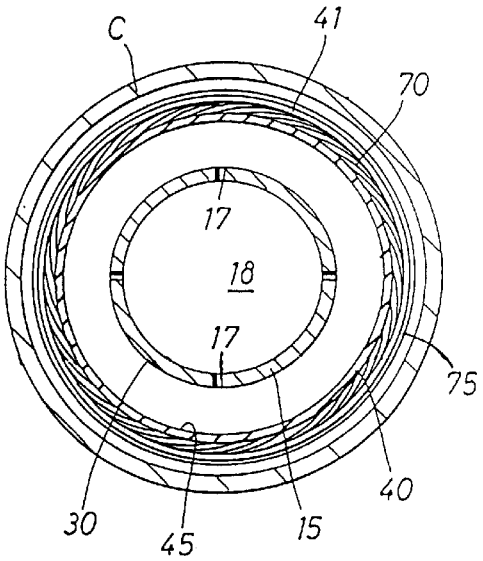
FIG. 3

PROGRAMMED SHAPE INFLATABLE PACKER DEVICE

CROSS-REFERENCE TO RELATED APPLICATION

This is a continuation of application Ser. No. 08/502,970 filed on Jul. 17, 1995, now U.S. Pat. No. 5,564,504 which is, in turn, a continuation of application Ser. No. 08/175,974, filed Dec. 30, 1993, now U.S. Pat. No. 5,469,919, issued Nov. 28, 1995.

BACKGROUND OF THE INVENTION

1. Field of the Invention

The invention relates to an inflatable packer device, such as a packer, bridge plug, or the like, for use in a subterranean well bore, and a method of using same.

2. Description of the Prior Art

Inflatable packers, bridge plugs, and the like have long been utilized in subterranean wells. Such inflatable tools normally comprise an inflatable elastomeric bladder element concentrically disposed around a central body portion, such as a tube or mandrel. A sheath of reinforcing slats or ribs is typically concentrically disposed around the bladder, with a thick-walled elastomeric packing cover concentrically disposed around at least a portion of the sheath, typically a central portion of the sheath. Pressured fluid is communicated from the top of the well or interior of the well bore to the bore of the body and thence through radial passages, or around the exterior of the body, to the interior of the bladder.

Normally, an upper securing means engages the upper end of the inflatable elastomeric bladder and reinforcing sheath (if included in the design), sealably securing the upper end of the bladder relative to the body, while a lower securing means engages the lower end of the bladder and reinforcing sheath, sealably and slidably securing the lower end of the bladder for slidable and sealable movement on the exterior of the body, in response to the inflation forces.

With inflatable packers of this type, it has been observed that the exposed anchor section of the packer prematurely inflates prior to the other sections of the packer which are reinforced against expansion by an elastomeric packing cover element. When an exposed portion, such as the upper exposed anchor section of the bladder, inflates, the lower end of the bladder moves upwards relative to the body, and the exposed portion inflates until it meets the wall of the well bore, which may be cased or uncased. If well bore is uncased, the well bore will have a wall, and if the well bore is cased, the wall of the well bore will be the interior of the casing.

Although not fully understood, as the inflation begins to propagate downward and the reinforced portions of the bladder begin to inflate, the bladder has a propensity to pinch around the exterior of the body, creating a seal that prevents the effective communication of further fluid to the lower portions of the bladder. As the upper portion of the bladder above the seal continues to inflate, a convoluted fold forms in the bladder at the point of the seal, thus entrenching the seal.

The seal prevents or obstructs passage of the pressured fluid, employed for inflating the inflatable bladder, from reaching the lower portions of the bladder. Further, if the bladder is successfully inflated, the convoluted fold often remains in the bladder. During deflation, this fold can similarly pinch and seal around the body, obstructing the communication of fluid out of the lower portions of the bladder and thereby preventing complete deflation of the bladder. This nonuniform axial inflation of the bladder also causes the ribs in the sheath to cut into the bladder.

Applicant is aware of the following prior art: U.S. Pat. Nos. 4,781,249, 4,897,139, and 4,979,570, which are related in subject matter.

The present invention addresses the nonuniform axial inflation and rib-cutting problems set forth above by providing an inflatable packer device and method of use which provides a series of shape controlling means disposed along the length of the bladder to cause substantially uniform axial inflation of the bladder.

SUMMARY OF THE INVENTION

The present invention provides an inflatable packer device and method of use thereof with the packer being introduceable into a subterranean well bore on a conduit, such packer being inflatable by pressured fluid communicated to the packer from an available source of pressured fluid located at the top of the well, interior of the well bore, or within the packer. The well bore may be cased or uncased. If well bore is uncased, the well bore will have a wall, and if the well bore is cased, the wall of the well bore will be the interior of the casing.

The packer has a body, with means on its upper end for selective engagement to the conduit. An inflatable elastomeric bladder is concentrically disposed around the exterior of the body, which is selectively movable between deflated and inflated positions by the application of pressured fluid applied to the interior of the bladder. The pressured fluid is communicated via a fluid transmission means from the source of pressured fluid, either to the bore of the body and thence through radial passages, or around the exterior of the body, and thence to the interior of the bladder. By the application of this pressured fluid, the bladder may be moved between deflated and inflated positions, so that the inflatable packer device may be moved into or out of sealing engagement with the wall of the well bore.

A first securing means engages one end of the bladder for sealably securing the bladder end to the body, while a second securing means engages the other bladder end of the bladder for sealably securing the other bladder end to the body. At least one of these securing means enables the bladder end to which it is engaged to move slidably relative to the body, in response to the inflation or deflation forces.

Finally, a series of shape-controlling means is disposed along the length of the bladder for causing substantially uniform axial inflation of the bladder, such that the ratio of the greatest circumference of the bladder to the smallest circumference of the bladder at any moment during inflation is always below a pre-determined maximum ratio. Thus, the heretofore mentioned nonuniform axial inflation and rib-cutting problems are eliminated.

BRIEF DESCRIPTION OF THE DRAWINGS

FIG. 1 is a half-sectional elevational view of a preferred inflatable packer device embodying this invention, with the elements of the packer shown inserted in a subterranean well bore in their non-inflated positions, prior to actuation for setting in the well bore.

FIG. 2 is a cross-sectional view of the section of the packer shown in FIG. 1, looking downward through the section indicated by line 2—2 on FIG. 1.

FIG. 3 is a view similar to that of FIG. 2 showing the inflatable packer device during inflation of the packer, prior to sealable engagement with the wall of the well bore.

DESCRIPTION OF THE PREFERRED EMBODIMENTS

Figure 5:
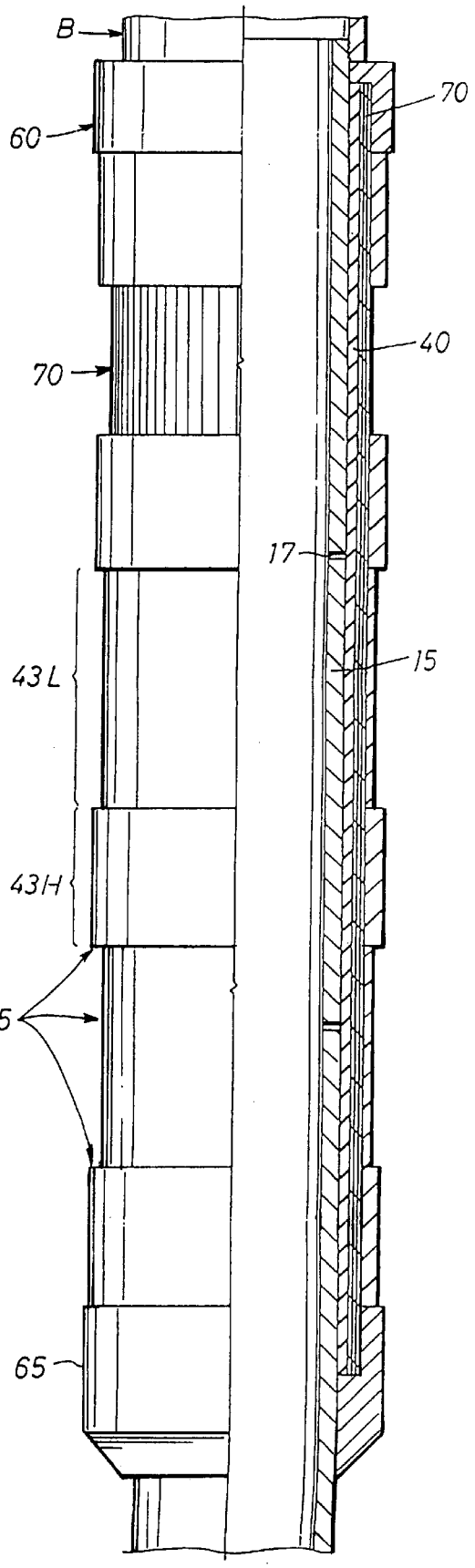
FIG. 5 is a half-sectional elevational view of an alternate preferred inflatable packer device embodying this invention, with the elements of the packer shown inserted in a subterranean well bore in their non-inflated positions, prior to actuation for setting in the well bore.

Now referring to FIG. 1, there is shown an inflatable packer device 10. The packer 10 may be provided in the form of a packer, bridge plug, tubing hanger, or the like, depending upon whether or not the bore of the packer 10 is open or closed.

The packer 10 contains a body 15 which may be provided in the form of a tube. The body 15 extends through the full length of the packer 10 and connects to the bottom of a conduit B, such as tubing in the form of a continuous length coiled tubing, or the like, which extends to the well surface (not shown). The conduit B may also be provided in the form of wire or electric line, or sectioned, threaded drill or production pipe, or casing. The body 15 is connected to the bottom of the conduit B by means on its upper end such as a threaded surface 20 engageable with conduit B.

An inflatable elastomeric bladder 40 is concentrically disposed around the body 15. The bladder may be surrounded and secured relative to a reinforcing sheath 70. The sheath 70 may be formed of a plurality of longitudinally extending slats or ribs with each of the longitudinally extending strips circumferentially overlapping an adjacent strip. The width of such strips and their arrangement in forming the sheath 70 is such that each of the strips will overlap the next adjacent strip when the bladder 40 is deflated and each strip will overlap the next adjacent strip when the inflatable bladder 40 is inflated, thus forming a reinforcing sheath 70 for the inflatable bladder 40 at all times.

The exterior of the reinforcing sheath 70 is either partially or completely surrounded and bonded to an outer annular elastomeric packing cover 75.

The first bladder end 50 and sheath 70 are sealably secured to the body 15 by a first securing means, such as a collar 60 mounted to the body. The second bladder end 55 and sheath 70 are sealably secured to the body 15 by a second securing means, such as a collar 65 mounted to the body. The second securing means, which includes the collar 65, is also engaged for movement slidably relative to the body 15, in response to the inflation forces.

The bladder 40 is selectively movable between deflated and inflated positions by the introduction of pressured fluid through a fluid transmission means such as the bore 18 and the radial ports 17 in the body 15. The pressured fluid is communicated in a known and conventional manner from the source of pressured fluid (not shown), through the bore 18 and the radial ports 17 to the interior 45 of the bladder 40. Alternatively, the body 15 may be solid, in which case pressured fluid may be introduced around the exterior 30 of the body 15. By the application of pressured fluid to the interior 45 of the bladder 40, the packer 10 may be inflated whereupon the second bladder end 55 and the second securing means comprised by the collar 65 move relative to the body and towards the first bladder end 50.

A series of shape-controlling means are disposed along substantially the entire length of the bladder 40, to cause substantially uniform inflation of the bladder 40 such that, at any moment during inflation, the ratio of the largest circumference of any section of the bladder 40 to the smallest circumference of any section of the bladder 40 is below a pre-determinable maximum ratio. The term "circumference" when used herein to refer to the circumference of a portion of the bladder 40 refers to the circumference of the exterior of the portion of the bladder 40. When used to refer to the circumference of a belt 41, the term "circumference" refers to the circumference of the interior of the belt 41. The term "smallest circumference" refers to the smallest circumference of any section of the bladder 40 at a given moment during inflation, excluding the portions of bladder ends 50 and 55 immediately near the collars 60 and 65, which portions retain a relatively small circumference throughout the entire inflation process.

In one embodiment of the invention, the series of shape-controlling means comprise a plurality of circumferential limiters, shown in FIG. 1 as belts 41, which are concentrically disposed between the sheath 70 and the cover 75, except for exposed portions of the sheath 70 which are not covered by the cover 75, in which case the belts 41 are disposed around the sheath 70. The belts 41 may be formed of any suitable material which is substantially nonelastic, and where each belt 41 is formed of the same material having a pre-determinable failing tension at which tension a belt 41 will break. Alternatively, the belts 41 may be formed with different materials, thicknesses, widths, and tensile strengths to achieve the desired pre-determinable failing tension.

The belts 41 have a circumference larger than the circumference of the bladder 40 in its uninflated position, but less than the circumference of the well bore casing wall C. The wall of the well bore A may be cased or uncased, and is shown cased in the figure. When the bladder 40 is in its uninflated position as shown in FIGS. 1 and 2, the belt has an excess length which is folded upon itself as shown in FIG. 2. As the bladder 40 begins to inflate, each belt 41 unfolds its excess length, until the circumference of a portion of the bladder 40 beneath a given belt 41 is equal to the circumference of that belt 41, at which point the belt is fully extended, as illustrated in FIG. 3.

The tensile strength of the belts 41 is selected such that all belts 41 must be fully extended before the pressured fluid introduced into the interior 45 of the bladder 40 causes enough tension to break or fail any of the belts 41. In this manner the belts 41 will become fully extended one by one as the bladder 40 inflates, so that if any belt 41 is not yet fully extended, the inflation pressure will be strong enough to inflate the relatively uninflated portions of the bladder 40 near the unextended belts 41 but not strong enough to break any of the fully extended belts 41. In this manner the bladder 40 inflates along its entire length out to an intermediate circumference, being the circumference of the fully extended belts 41. During inflation to this intermediate circumference, the largest circumference of any portion of the bladder 40 is substantially limited to the circumference of the belts 41, and the smallest circumference of the bladder is the circumference of the bladder 40 in its uninflated position. The length of the belts 41 is selected so that the ratio of these circumferences is less than the maximum pre-determined ratio, to prevent formation of the aforementioned pinch and seal and to prevent the ribs in the sheath 70 from cutting into the bladder 40.

Figure 4:
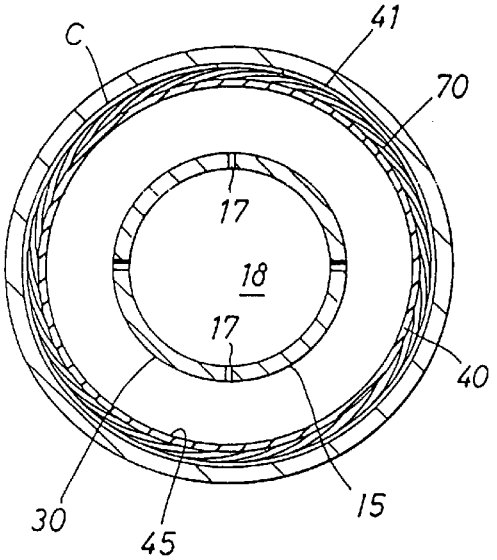
FIG. 4 is a view similar to that of FIG. 2 showing the inflatable packer device subsequent to inflation and sealably engaged with the wall of the well bore.

After the bladder 40 has inflated such that each belt 41 has been fully extended, the inflation pressures increase and reach a point where the tension on some of the belts 41 becomes high enough so that the belts 41 break or fail. Thus the belts 41 fail, one by one, until each has failed and the bladder 40 may thus fully inflate along its entire length, moving the cover 75 and the exposed section of the sheath 70 into sealing engagement with the casing C of the well bore A, as illustrated in FIG. 4.

During inflation from the intermediate circumference to the circumference of the well bore casing wall C, the largest circumference of any portion of the exterior 46 of the bladder 40 is limited to the circumference of the well bore casing C, and the smallest circumference of the bladder is the circumference of the belts 41. The length of the belts 41 is such that the ratio of these circumferences is less than the maximum pre-determined ratio, to prevent to formation of the aforementioned pinch and seal and to prevent the ribs in the sheath 70 from cutting into the bladder 40.

In a second embodiment of the invention, as shown in FIG. 5, the series of shape-controlling means comprise a plurality of variably inflation-resistant modules 43, which are integral components of the cover 75, concentrically disposed around the sheath 70. As illustrated in FIG. 5, some of the modules 43 are formed from a relatively thicker piece of elastomer and are called "high modulus modules," an example of which is module 43H, while others of the modules 43 are formed of relatively thinner pieces of elastomer, and are called "low modulus modules," an example of which is module 43L. The low modulus modules such as module 43L have less resistance to stretching and thus to inflation forces since they are formed of a thinner piece of elastomer, while the high modulus modules such as module 43H require a higher tension to stretch and thus inflate, since they are formed of relatively thicker pieces of elastomer. The modules 43, while acting as shape-controlling means, also continue to act as a packing cover 75 to provide a means for a pressure-tight hydraulic seal against the casing C.

Preferably, each module 43 will have a length equal to one to two times the diameter of the cover 75 in its uninflated position, typically three to six inches in axial length, but may be of different lengths depending upon the non-uniform inflation characteristics sought to be controlled in the bladder 40. The modules 43 are shown disposed axially along the length of the bladder 40, alternating between high and low modulus modules, with an area of the sheath 70 left uncovered by any module 43. With these variably-inflation resistant modules 43 suitably and alternatingly axially arranged along the length of the bladder 40, an overall substantial uniformity of resistance to inflation pressures is achieved, such that the bladder 40 inflates substantially uniformly along its axial length, from its run-in position until its fully-expanded position whereby the packer 10 is moved into sealing engagement with the well bore casing wall C. Since the inflation of the bladder 40 is substantially uniform along its length, the ratio of the circumferences of any more-expanded portions to that of less-expanded portions is less than the maximum pre-determined ratio, thereby preventing the formation of the aforementioned pinch and seal and preventing the ribs in the sheath 70 from cutting into the bladder 40.

It will be appreciated that the low and high modulus modules 43 may also have a uniform thickness but be formed of different elastomeric composites with different resistivities to stretching. Additionally, the low and high modulus modules 43 may be formed from a single tube of elastomer or from separate sections of elastomer situated contiguously along the sheath, and the separate sections may further be bonded to each other. Alternatively, the low modulus modules 43L may comprise sections of elastomer or other suitable material that break after an initial amount of inflation and fall off of the packer 10, still allowing the desired programmed shape control and also exposing multiple sections of the sheath 70 to provide multiple anchoring segments to anchor against the casing wall C.

With any embodiment of the invention, the packer 10 is lowered into the top (not shown) of the well bore A on the conduit B to a pre-determinable position. At this position the packer 10 may be moved into sealing engagement with the well bore casing wall C by the introduction of pressured fluid communicated to the packer 10 from a source of pressured fluid (not shown) located at the top of or within the well bore A. Alternatively, the source of pressured fluid may be located within the packer 10 or within its setting tool (not shown).

After actuation of the packer 10, the packer 10 may be deflated and thereupon removed from the well bore A or moved to a new pre-determinable position within the well bore A for subsequent actuation.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable packer device for use in a subterranean well bore having a wall and carryable into said well bore on a conduit, said inflatable packer device being inflatable by pressured fluid communicated to the packer from a source of pressured fluid, said inflatable packer device comprising:

(a) a body having means at its upper end for selective engagement to said conduit, said body further having an exterior surface;

(b) an inflatable elastomeric bladder concentrically disposed around said body, said bladder having an interior, the bladder further having a first bladder end and a second bladder end, the bladder further being selectively movable between deflated and inflated positions, the bladder further having a largest circumference and a smallest circumference;

(c) first securing means engageable with one of said bladder ends for sealably securing said bladder end to said body;

(d) second securing means being engageable with the other of said bladder ends for sealably securing said other bladder end to said body, at least one of said first and second securing means enabling at least one of said bladder ends to slidably move relative to said body during inflation of said bladder;

(e) fluid transmission means for communicating said pressured fluid between the source of pressured fluid and the interior of the bladder to move the bladder between each of deflated and inflated positions, whereby the inflatable packer device may be moved into one of sealing and unsealing relationship with said wall of said well bore;

(f) a re-enforcing sheath surrounding and secured relative to said bladder; and (g) an elastomeric packing cover concentrically disposed around said sheath, said cover including a series of shape-controlling means along the length of said bladder and, after inflation, further providing a pressure-tight seal between the well wall and the conduit for causing substantially uniform, axial inflation of said bladder, whereby the shape-controlling means result in the ratio of the largest circumference of the bladder to the smallest circumference of the bladder during inflation being reduced and prevented from exceeding a pre-determined maximum ratio, wherein said series of shape-controlling means comprise a plurality of inflation-resistant modules integrally disposed within and on said cover, such that each of said modules is an integral component of said cover, said modules including at least one high modulus modules formed from a relatively thick elastomer and having a first resistance to stretching and inflation forces, said modulus module including at least one low modulus formed from a relatively thinner elastomer than the at least one high modulus module and having a resistance to stretching and inflation forces less than those of the said at least one high modulus module, said module having a circumference larger than the circumference of said bladder in its uninflated position, but less than the circumference of the well bore, said high and low modulus modules being formed of separate sections of elastomer bonded together.

2. An inflatable packer device for use in a subterranean well bore having a wall and carryable into said well bore on a conduit, said inflatable packer device being inflatable by pressured fluid communicated to the packer from a source of pressured fluid, said inflatable packer device comprising:

(a) a body having means at its upper end for selective engagement to said conduit, said body further having an exterior surface;

(b) an inflatable elastomeric bladder concentrically disposed around said body, said bladder having an interior, the bladder further having a first bladder end and a second bladder end, the bladder further being selectively movable between deflated and inflated positions, the bladder further having a largest circumference and a smallest circumference;

(c) first securing means engageable with one of said bladder ends for sealably securing said bladder end to said body;

(d) second securing means being engageable with the other of said bladder ends for sealably securing said other bladder end to said body, at least one of said first and second securing means enabling at least one of said bladder ends to slidably move relative to said body during inflation of said bladder;

(e) fluid transmission means for communicating said pressured fluid between the source of pressured fluid and the interior of the bladder to move the bladder between each of deflated and inflated positions, whereby the inflatable packer device may be moved into one of sealing and unsealing relationship with said wall of said well bore;

(f) a re-enforcing sheath surrounding and secured relative to said bladder; and (g) an elastomeric packing cover concentrically disposed around said sheath, said cover including a series of shape-controlling means along the length of said bladder and, after inflation, further providing a pressure-tight seal between the well wall and the conduit for causing substantially uniform, axial inflation of said bladder, whereby the shape-controlling means result in the ratio of the largest circumference of the bladder to the smallest circumference of the bladder during inflation being reduced and prevented from exceeding a pre-determined maximum ratio, wherein said series of shape-controlling means comprise a plurality of inflation-resistant modules integrally disposed within and on said cover, such that each of said modules is an integral component of said cover, said modules including at least one high modulus modules formed from a relatively thick elastomer and having a first resistance to stretching and inflation forces, said modulus module including at least one low modulus formed from a relatively thinner elastomer than the at least one high modulus module and having a resistance to stretching and inflation forces less than those of the said at least one high modulus module, said module having a circumference larger than the circumference of said bladder in its uninflated position, but less than the circumference of the well bore said, low modulus modules comprising an elastomer which breaks and falls off of said packer after an initial amount of inflation of the bladder, to thereby expose multiple sections of said sheath, thereby providing multiple anchoring segments for anchoring against the well wall when the bladder is moved from deflated to inflated position.

* * * * *